United States Patent [19]

French

[11] Patent Number: 4,838,339

[45] Date of Patent: Jun. 13, 1989

[54] MOLD FOR HOLLOW POINT BULLET

[75] Inventor: Kendrick L. French, Lebanon, Me.

[73] Assignee: K. W. Thompson Tool Company, Inc., Rochester, N.H.

[21] Appl. No.: 89,723

[22] Filed: Aug. 26, 1987

[51] Int. Cl.[4] ..... B22D 17/24

[52] U.S. Cl. ..... 164/340; 164/342; 164/264; 249/171; 249/177

[58] Field of Search ..... 164/262, 264, 340, 342, 164/341; 249/59, 170, 171, 172, 177

[56] References Cited

U.S. PATENT DOCUMENTS

| | | | |
|---|---|---|---|
| 598,355 | 2/1898 | Borcur | 164/264 |
| 936,475 | 10/1909 | Putney | 249/171 |
| 3,749,351 | 7/1973 | Lee | 249/170 |
| 3,870,272 | 3/1975 | Jackman | 249/170 |

*Primary Examiner*—Richard K. Seidel

*Attorney, Agent, or Firm*—Blodgett & Blodgett

[57] ABSTRACT

A mold for a grooved hollow point bullet having a pair of separable mold halves which are mounted in a bullet molding apparatus for movement between a closed position and an open position. Each mold half has a flat parting surface which has a bullet shaped groove and an elongated shallow groove which extends from the bullet shaped groove to one end of the mold half. When the mold halves are in the closed position so that the parting surfaces of the mold halves abut, the bullet shaped grooves of the mold halves combine to form a bullet shaped cavity and the elongated shallow grooves combine to form a bore which leads from the bullet shaped cavity to the end of the mold. An elongated pin for forming a hollow point bullet is mounted on one of the mold halves so that it extends through the bore and into the bullet cavity. The pin is mounted on one of the mold halves so that it remains with the mold half throughout the casting process, including the separation of the mold halves and ejection of the cast bullet from the mold.

4 Claims, 3 Drawing Sheets

FIG. 1
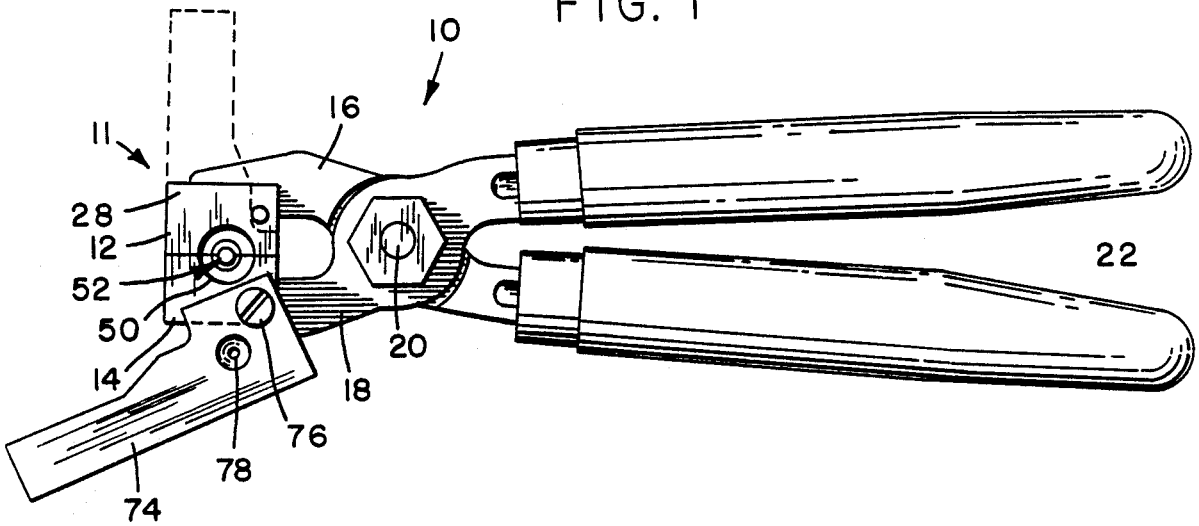
FIG. 2
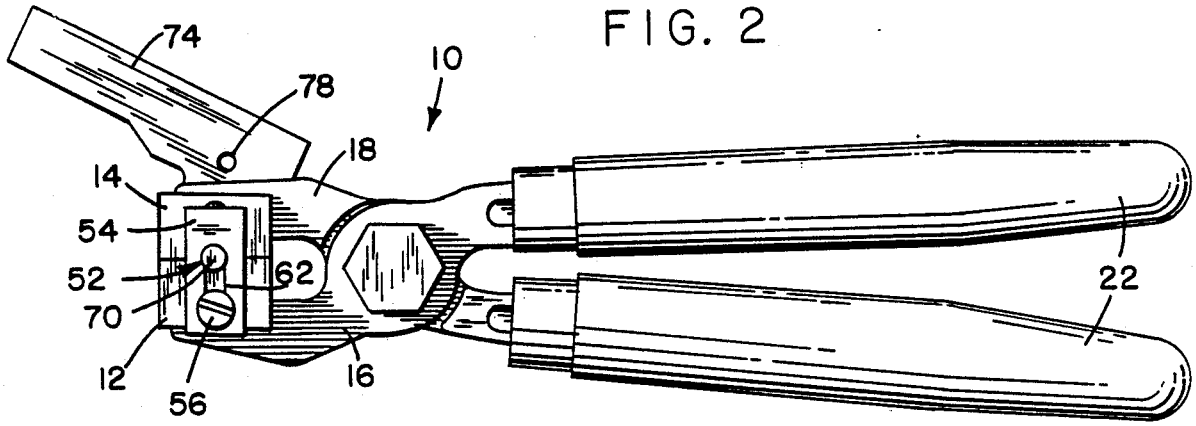
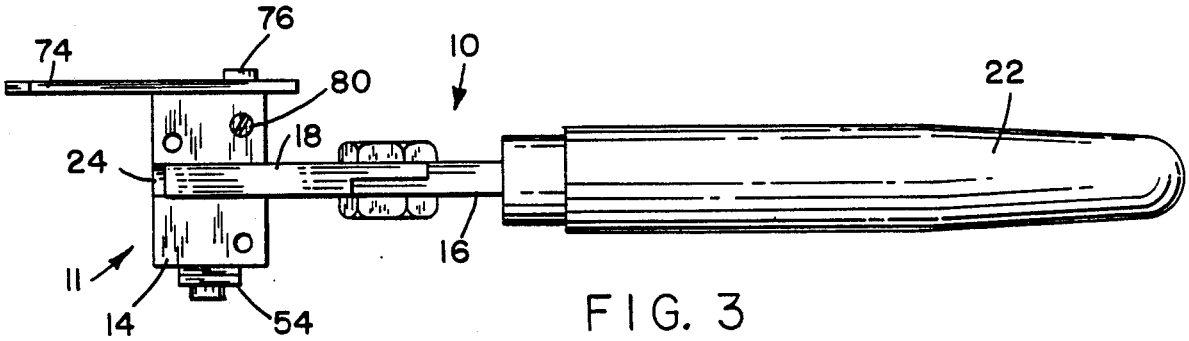
FIG. 3

MOLD FOR HOLLOW POINT BULLET

BACKGROUND OF THE INVENTION

The present invention relates generally to a mold for casting hollow point bullets and particularly to a mold for casting hollow point bullets which have annular grooves.

Most serious shooting enthusiasts reload their own cartridges and many of these individuals also mold their own bullets. The conventional bullet molding device includes a pair of levers which are pivoted together in scissor-like fashion. One end of each lever includes a handle. The opposite end of each lever has a mold half. Each mold half has a parting surface which contains a depression which is in the shape of half a bullet. The mold halves are mounted on their respective levers so that the parting surfaces of the mold halves face each other. When the handles are moved towards each other, the mold halves also move towards each other until the parting surfaces of the mold halves abut. The depressions in the mold halves are aligned so that they form a cavity which has the shape of the bullet to be cast. Locating pins are employed to ensure perfect alignment of the mold halves.

When a hollow point bullet is molded, one of the molds is provided with a pin which extends partly into the cavity. However, a certain type of bullet which is used for muzzle loading firearms cannot be molded in this manner if the bullet is to have a hollow point. The muzzle loading bullet is provided with one or more annular grooves. The bullet cannot be removed in the axial direction because of the grooves or in a direction which is transverse to the longitudinal axis of the bullet because of the pin. Either, the bullet is cast without a hollow point so that the hollow point can be formed after casting by drilling or the mold is provided with a removable hollow point forming pin. In the latter case, the parting surface of each mold half also has an elongated shallow depression which extends from the bullet-shaped depression to the opposite end of the mold. The shallow depressions combine to form a bore which leads from the opposite end of the mold to the bullet cavity when the mold halves are joined. The bore is adapted to receive an elongated pin of an awl-shaped fixture. The fixture and mold are provided with complementary locking means to hold the fixture on the mold in a predetermined position. When the fixture is in the predetermined position, the pin extends into the mold cavity. When the bullet is cast, the fixture is removed from the mold, thereby forming an aperture in the front end of the bullet and thereby forming a so-called hollow point bullet.

One of the disadvantages of the conventional mold for grooved hollow point bullets is that the mold requires an extra removable fixture which can be lost or misplaced. Also, the process of applying and removing the fixture from the mold adds extra steps to the bullet casting process which makes the production of grooved hollow point bullets very slow compared to conventional bullets. These and other difficulties experienced with the prior art devices have been obviated by the present invention.

It is, therefore, a principle object of the invention to provide a mold for a grooved hollow point bullet which includes a hollow point fixture which is attached to the mold, remains attached to the mold during and after the entire bullet casting process and which allows the cast bullet to be removed from the mold.

A further object of the present invention is the provision of a mold for grooved hollow point bullets which remains attached to the mold during casting of bullets and at other times and which can also be removed from the mold if desired so that fixtures with different pin lengths can be selectively used.

A still further object of the invention is the provision of a mold for a hollow point bullet which is simple in construction, which is inexpensive to manufacture and which is capable of a long life of useful service.

With these and other objects in view, as will be apparent to those skilled in the art, the invention resides in the combination of parts set forth in the specification and covered by the claims appended hereto.

SUMMARY OF THE INVENTION

The invention consists of a mold for a grooved hollow point bullet; the mold includes a pair of separable, nearly identical mold halves. Each mold half includes a flat parting surface having a deep groove at one end and an elongated shallow groove which extends from the deep groove to the opposite end of the flat surface. The deep groove has one or more transverse ridges. When the mold halves are joined so that the parting surfaces abut, the deep grooves combine to form a bullet cavity having one or more annular ridges and the shallow grooves combine to form a bore leading into the bullet cavity. An elongated pin extends through the bore and partially into the bullet cavity causing a hollow point to be formed in a bullet which is cast in the mold. The pin is mounted on one of the mold halves so that the pin has limited transverse movement which is sufficient to permit the cast bullet to move transversely of the parting face of the mold half when the mold halves are separated. The transverse movement of the bullet is just enough to allow the bullet to clear the ridges of the deep groove.

BRIEF DESCRIPTION OF THE DRAWINGS

The character of the invention, however, may be best understood by reference to one of its structural forms, as illustrated by the accompanying drawings, in which:

FIG. 1 is a top plan view of a bullet mold embodying the principles for the present invention, FIG. 2 is a bottom plan view of the bullet mold, FIG. 3 is a front elevational view of the bullet mold.

DESCRIPTION OF THE PREFERRED EMBODIMENT

Figure 4:
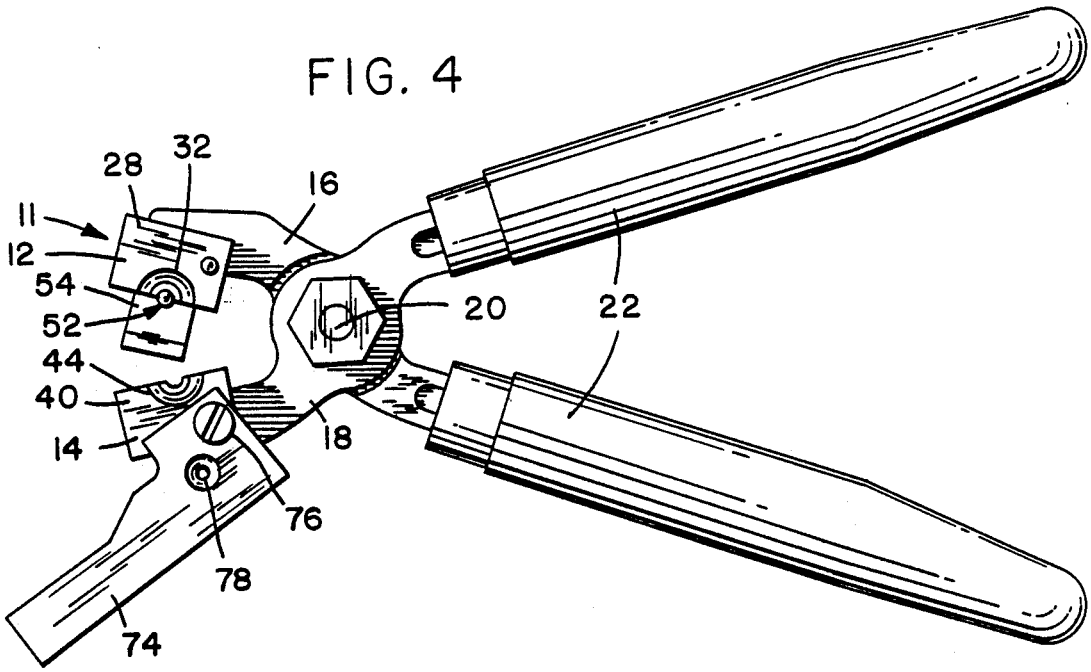
FIG. 4 is a top plan view of the bullet mold, showing the mold halves in the open or separated position.

Referring first to FIGS. 1–3, there is shown a molding device, generally indicated by the reference numeral 10, which includes a mold for a hollow point bullet, generally indicated by the reference numeral 11. The device 10 is a single bullet hand operated molding device. The mold of the present invention is also applicable to multi-bullet hand operated molding devices and high production automated molding devices. The mold 11 comprises a first mold half 12 and a second mold half 14. The mold half 12 is attached to one end of a first lever 16. The second mold half 14 is attached to one end of a second lever 18. The first and second levers, 16 and 18 respectively, are pivotably connected by means of a pivot pin 20. The opposite end of each of the levers 16 and 18 is provided with a handle 22. The bullet molding device 10 operates in scissor-like fashion so that when the handles 22 are moved away from each other from the closed position shown in FIG. 1 to the open position shown in FIG. 4, the mold halves 12 and 14 are separated as shown in FIG. 4. The mold halves 12 and 14 are returned to the closed position as shown in FIG. 1 by moving the handles toward each other from the position shown in FIG. 4 to the position shown in FIG. 1. Each mold half is provided with a groove 24 for receiving the end of its respective lever. The lever and mold half are bolted together.

Figure 5:
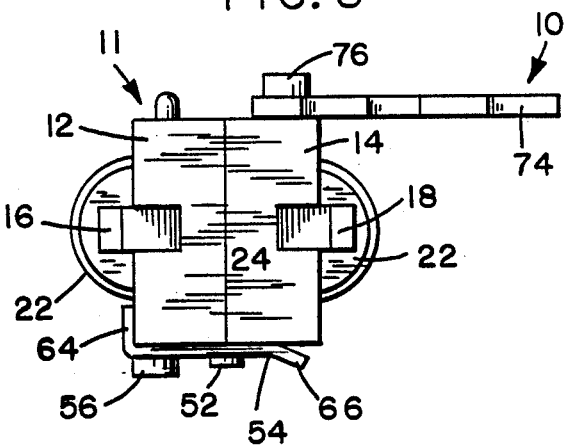
FIG. 5 is a left end elevational view of the bullet mold.
Figure 8:
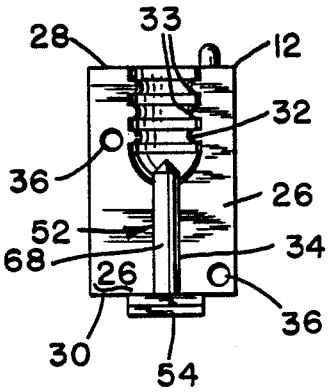
FIG. 8 is an elevational view of the parting surface of one of the mold halves.
Figure 9:
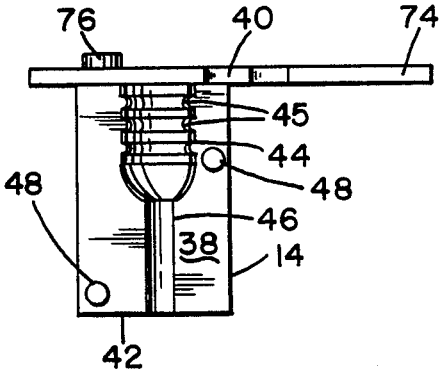
FIG. 9 is an elevational view of the parting surface of the other mold half.
Figure 10:
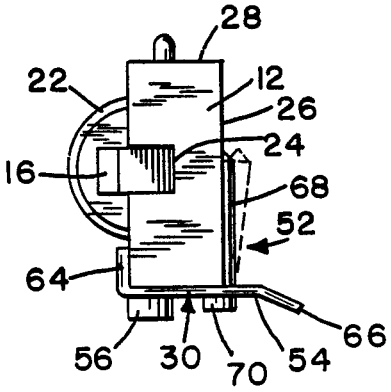
FIG. 10 is a left end elevational view of the mold half on which the hollow point forming pin is mounted.

Referring also to FIGS. 8–10, the first mold half 12 comprises a flat parting surface 26, a first or top end surface 28 and a second or bottom end surface 30. The flat parting surface 26 has a relatively deep groove 32 which extends from a midpoint of the parting surface through the top end surface 28 and an elongated relatively shallow groove 34 which extends from the deep groove 32 through the bottom end surface 30. The groove 32 has a plurality of transverse ridges 33. The parting surface 26 also includes a pair of locating holes 36. Referring particularly to FIG. 9, the second mold half 14 comprises a flat parting surface 38, a first or top end surface 40 and a second or bottom end surface 42. The parting surface 38 comprises a relatively deep groove 44 which extends from a midpoint of the parting surface through the top end surface 40 and a relatively shallow elongated groove 46 which extends from the deep groove 44 through the bottom end surface 42. The deep groove 44 has a plurality of transverse ridges 45. A pair of locating pins 48 extends transversely of the parting surface 38. The pins 48 are axially aligned with the holes 36 when the mold halves 12 and 14 are brought together as shown in FIG. 5. When the mold halves 12 and 14 are joined together as shown in FIG. 5 so that the parting surfaces 26 and 38 abut, the pins 48 enter the holes 36 to ensure that the deep grooves 32 and 44 are aligned to define a bullet-shaped cavity 50, see FIG. 1. The ridges 22 and 45 combine to form annular ridges within the cavity 50. The shallow grooves 34 and 46 also combine to define an elongated bore which leads from the bottom end surface 42 into the bullet cavity 50.

Figure 6:
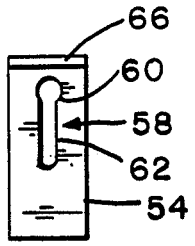
FIG. 6 is a bottom plan view of a bracket for supporting the pin in the mold.
Figure 7:
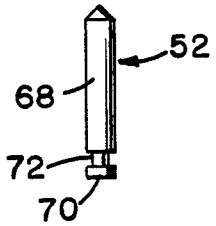
FIG. 7 is a front elevational view of a pin for forming a hollow point in a cast bullet.

Referring particularly to FIGS. 7, 8 and 10, an elongated pin 52 is mounted on the mold half 12 by means of a bracket 54 so that the pin lies within the shallow groove 34 and extends partly into the deep groove 32. The bracket 54 is removably attached to the mold half 12 by means of a bolt 56. Referring particularly to FIG. 6, the bracket 54 contains a slot which is generally indicated by the reference numeral 58 and comprises a circular, relatively wide portion 60 and an elongated, relatively narrow portion 62. The bracket 54 includes a flange 64 at one end for positioning the bracket 54 so that the pin 52 is aligned with the shallow groove 34. The other end of the bracket 54 has an outwardly bent portion 66 which functions as an aligning guide for the two mold halves when the two mold halves are brought together as shown in FIG. 5.

Referring particularly to FIG. 7, the pin 52 comprises an elongated main body portion 68, a head portion 70 and a neck portion 72 which is located between the head portion 70 and the main body portion 68. The pin 52 is cylindrical. The diameter of the main body portion 68 and the head portion 70 is slightly greater than the diameter of the circular portion 60 so that the pin 52 can pass freely through the circular portion 60 of the slot 58. The diameter of the main body portion 68 and of the head portion 70 is slightly greater than the width of the elongated narrow portion 62 of the slot 58. The diameter of the neck portion 72 is slightly less than the width of the elongated narrow portion 62 of the slot. The length of the neck portion 72 is slightly greater than the thickness of the bracket 54. The pin 52 is mounted in the bracket 54 by passing the pin 52 through the circular, relatively wide portion 60 until the neck portion 72 is aligned with the relatively narrow portion 62. This allows the pin 52 to move along the narrow portion 62 of the slot 58. The head portion 70 is located on one side of the bracket while the main body portion 68 is located on the other side of the bracket. This prevents the pin 52 from moving axially relative to the bracket 54. The bracket 54 is mounted on the mold half 12 by positioning the pin 52 near the end of the elongated portion 62 of the slot 58 so that it extends in the same direction as the flange 64. The bracket 54 is then positioned on the mold half 12 as shown in FIG. 10. The bracket 54 is fixed to the first mold half 12 by passing the bolt 56 through the circular portion 60 of the slot and threading the bolt into the mold half 12. The bolt 56 also extends through the lever 16 for mounting the first mold half 12 on the end of the lever 16. Pin 52 is loosely held in the narrow portion 62 of the slot 58 so that it is free to pivot slightly away from the narrow groove 34 about the bracket 54 to the extent shown in dotted lines in FIG. 10. Otherwise, when the mold halves are joined together the pin 52 fully occupies the bore which is formed by the grooves 34 and 46. A sprue cutter plate 74 is pivotly mounted on the top end surface 40 of the second mold half 14 by means of a bolt 76. A bolt 76 extends freely through the plate 74 and is prevented from turning relative to the second mold half 14 by means of a set screw 80, see FIG. 3.

The operation and advantages of the present invention will now be readily understood in view of the above description. When casting a grooved hollow point bullet, the bullet molding device 10 is held in the closed position as shown in FIG. 1 so that the parting surfaces 26 and 38 abut. The sprue cutter plate 74 is shown in the dotted line position of FIG. 1 so that the aperture 78 is axially aligned with the bullet cavity 50. Molten metal is poured through the aperture 78 into the bullet cavity 50 until the cavity is filled and molten material occupies the aperture 78. When the bullet material solidifies, the casting plate 74 is pivoted to the full line position shown in FIG. 1, thereby breaking the sprue which is formed in the aperture 78 from the body of the bullet. Bullet molding device 10 is then inverted as shown in FIG. 2 and the handles 22 are moved away from each other to separate the mold halves 12 and 14. When the mold halves 12 and 14 are separated, the bullet which is formed by the cavity 50 remains with the mold half 12 because of the pin 52. However, the bullet falls away from the mold half 12 when the mold half is given a slight jar. The looseness of the pin 52 when the mold halves are separated, enables the bullet to move transversely away from the deep groove 52 sufficiently to clear the ridges 33 and drop away from the mold half 12.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. A mold for a hollow point bullet having at least one annular groove which is coaxial with the central longitudinal axis of the bullet, said mold comprising:

(a) a first mold half having a first end surface, a second end surface which is opposite said first end surface, a first flat parting surface which extends from said first end surface to said second end surface, said first flat parting surface having a deep groove which is adjacent said first end surface and which extends into said first end surface, and a shallow groove which is adjacent said second end surface and which extends into said first deep groove, (b) a second mold half which is similar to said first mold half and which includes a second flat parting surface having a deep groove and a shallow groove, (c) means for joining and aligning said first and second mold halves so that their flat parting surfaces abut, their deep grooves combine to form a bullet cavity, and their shallow grooves combine to form a bore which leads into said bullet cavity, (d) an elongated pin which extends through said bore and partially into said cavity for causing a hollow point to be formed in a bullet which is cast in said mold, (e) a bracket which is fixed to one of said mold halves for supporting said pin outside of said shallow groove so that said pin extends freely into said shallow groove, said pin being pivotally mounted on said bracket for limited pivoting movement relative to the bracket away from said first parting surface so that when the mold halves are separated, said pin is able to move away from said first parting surface sufficiently to allow a bullet which is cast in said mold to clear the ridge in the deep groove of said first mold half and be removed from said mold, and (f) means for fastening said bracket in a fixed position on said first mold half.

2. A mold as recited in claim 1, wherein the means for joining said mold halves comprises a first lever which is removably connected to said first mold by means of said fastener and a second lever which is removably connected to said first lever for moving said mold halves toward and away from each other.

3. A mold as recited in claim 1, wherein said bracket extends transversely of and substantially beyond the parting surface of said first mold half, the extending portion of said bracket having an end which bends away from said mold so that said bracket guides said first and second mold halves into alignment when the mold halves are brought together.

4. A mold for a hollow point bullet having at least one annular groove which is coaxial with the central longitudinal axis of the bullet, said mold comprising:

(a) a first mold half having a first end surface, a second end surface which is opposite said first end surface, a first flat parting surface which extends from said first end surface to said second end surface, said first flat parting surface having a deep groove which is adjacent said first end surface and which extends into said first end surface, and a shallow groove which is adjacent said second end surface and which extends into said first deep groove, (b) a second mold half which is similar to said first mold half and which includes a second flat parting surface having a deep groove and a shallow groove, (c) means for joining and aligning said first and second mold halves so that their flat parting surfaces abut, their deep grooves combine to form a bullet cavity, and their shallow grooves combine to form a bore which leads into said bullet cavity, (d) an elongated pin which extends through said bore and partially into said cavity for causing a hollow point to be formed in a bullet which is cast in said mold, (e) a bracket for supporting said pin outside of said shallow groove so that said pin extends freely into said shallow groove, said pin being held by said bracket for limited pivoting movement relative to the bracket away from said first parting surface so that when the mold halves are separated said pin is able to move away from said first parting surface sufficiently to allow a bullet which is cast in said mold to clear the ridge in the deep groove of said first mold half and be removed from said mold, (f) means for fastening said bracket in a fixed position on said first mold half, wherein said bracket is removably mounted on said first mold by removable fastening means, said bracket comprising a slot which has an elongated, relatively narrow portion at one end of the slot and a relatively wide portion at the opposite end of the slot, for receiving said fastener and, wherein said pin has a central longitudinal axis and comprises:

(g) a main body portion which occupies said bore and which is wider transversely of said longitudinal axis than the narrow portion of said slot, (h) a head portion which is wider transversely of said longitudinal axis than the narrow portion of said slot, at least one of said head and narrow portions being narrower than the wide portion of said slot to allow said, in to move axially into the wide portion of said slot, and (i) a neck portion between said head portion and said main body portion, said neck portion being narrower transversely of said longitudinal axis than the narrow portion of said slot, the length of said neck portion along said axis being greater than the thickness of said bracket to enable said neck portion to be located in said narrow portion so that the head and main body portions of said pin are on opposite sides of said bracket.

* * * * *